United States Patent [19]

Kuder et al.

[11] Patent Number: 4,473,372

[45] Date of Patent: Sep. 25, 1984

[54] PROCESS FOR THE STABILIZATION OF ACRYLIC FIBERS

[75] Inventors: James E. Kuder, Fanwood; George L. Collins, Maplewood, both of N.J.; Thyagaraja Sarada, Norwalk, Conn.

[73] Assignee: Celanese Corporation, New York, N.Y.

[21] Appl. No.: 494,092

[22] Filed: May 12, 1983

[51] Int. Cl.[3] ..... H05B 1/00; B06B 3/00

[52] U.S. Cl. ..... 8/115.5; 204/159.14; 264/23; 264/22; 264/29.2; 264/29.6; 423/447.6; 8/927; 8/DIG. 12

[58] Field of Search ..... 8/115.5; 204/159.14; 423/447.6; 264/29.2, 23, 22; 8/DIG. 12

[56] References Cited

U.S. PATENT DOCUMENTS

| | | | |
|---|---|---|---|
| 3,539,295 | 10/1970 | Ram | 8/115.5 |
| 3,699,210 | 10/1972 | Binning et al. | 423/447 |
| 4,002,426 | 1/1977 | Chenevey et al. | 8/115.5 |
| 4,004,053 | 1/1977 | Gump et al. | 427/379 |
| 4,147,745 | 4/1979 | Sano et al. | 264/22 |
| 4,190,623 | 2/1980 | Bobeth et al. | 264/22 |
| 4,283,359 | 8/1981 | Tsutsui et al. | 264/22 |

OTHER PUBLICATIONS

R. W. Moncrieff, "Man-Made Fibres" (Wiley, 1975), Sixth Edition, pp. 555–556, 649–650.

*Primary Examiner*—A. Lionel Clingman

*Attorney, Agent, or Firm*—Burns, Doane, Swecker & Mathis

[57] ABSTRACT

The present invention provides an improved process whereby the thermal stabilization of acrylic fibers is accelerated. The process comprises providing a zone of electron radiation and continuously passing a continuous length of acrylic fibrous material through the zone so as to provide an energy absorption of from about 5 to about 30 megarads. The residence time of the acrylic fibrous material in the zone of electron radiation is less than five seconds. The continuous length of acrylic fibrous material is subsequently continuously passed through a thermal stabilization zone wherein the acrylic fibrous material is heated in an oxygen-containing atmosphere provided at a temperature in the range of about 220° C. to 310° C. for about 10 to 30 minutes. The acrylic fibrous material formed thereby is thermally stabilized (i.e., black in appearance, retains its original fibrous configuration substantially intact, and is non-burning when subjected to an ordinary match flame). The electron radiation treatment has surprisingly been found to accelerate the desired thermal stabilization when compared to prior art processes which do not include the treatment of acrylic fibrous material by electron radiation.

9 Claims, No Drawings

PROCESS FOR THE STABILIZATION OF ACRYLIC FIBERS

BACKGROUND OF THE INVENTION

It is well known that acrylic fibrous materials, when subjected to heat, undergo a thermal stabilization reaction wherein the fibrous material is transformed to a black form which is non-burning when subjected to an ordinary match flame.

Such modification generally has been accomplished by heating the acrylic fibrous material in an oxygen-containing atmosphere. It is believed that the resulting thermal stabilization reaction involves (1) an oxidative crosslinking reaction of adjoining molecules, (2) a cyclization reaction of pendant nitrile groups to a condensed dihydropyridine structure, and (3) a dehydrogenation reaction. The cyclization reaction is exothermic in nature and must be controlled if the fibrous configuration of the acrylic polymer undergoing stabilization is to be preserved. The thermal stabilization reaction heretofore has generally been believed to be diffusion controlled and to require considerable time for oxygen to enter the interior portions of the fiber.

On a commercial scale, the thermal stabilization reaction commonly is carried out on a continuous basis with a continuous length of a multifilament acrylic fibrous material being passed in the direction of its length through a thermal stabilization zone which is provided with a heated gaseous atmosphere. The movement of the continuous length of acrylic fibrous material through the stabilization zone containing the heated gaseous atmosphere may be directed by rollers situated therein. The continuously moving length of acrylic fibrous material must be heated in air at approximately 250° C. for two to three hours to completely stabilize the material. This time consuming thermal stabilization greatly increases the eventual cost of the carbon fiber produced from the acrylic fibrous material.

Representative United States patents which concern the thermal stabilization of an acrylic fibrous material include: U.S. Pat. Nos. 3,285,696; 3,539,295; 3,699,210; 3,826,611; 3,961,888; 4,186,179; and Re. No. 30,414. Since the thermal stabilization reaction has tended to be unduly time consuming, various routes have been proposed to expedite the desired reaction through some form of catalysis and/or chemical modification of the acrylic fibrous precursors. See, for instance, the following United States patents which are representative of this approach: U.S. Pat. Nos. 3,592,595; 3,650,668; 3,656,882; 3,656,883; 3,708,326; 3,729,549; 3,813,219; 3,820,951; 3,850,876; 3,923,950; 4,002,426; and 4,004,053.

The resulting acrylic fibrous materials can be used in the formation of non-burning fabrics. Alternatively, the stabilized acrylic fibrous materials can be used as precursors in processes for the formation of carbon or graphitic carbon fibers. U.S. Pat. Nos. 3,775,520 and 3,954,950 disclose representative overall processes for forming carbon fibers beginning with an acrylic precursor.

There has remained a need for a simple expeditious process for the formation of thermally stabilized acrylic fibrous materials. Such need is particularly acute in the overall context of carbon fiber production since the carbonization or carbonization and graphitization portions of the overall process commonly require a considerably lesser residence time than the initial thermal stabilization portion of the process. Accordingly, heretofore it has been essential to provide extremely large ovens in order to accomodate the acrylic fibrous material undergoing thermal stabilization if the entire process is carried out on a continuous basis with the fibrous material passing directly from the stabilization zone to the carbonization zone.

It has heretofore been proposed to apply ionizing radiation to acrylonitrile monomer, at very low temperatures, prior to the polymerization and spinning of the polymeric acrylic fibers which are subsequently thermally stabilized and carbonized. See, for example, U.S. Pat. No. 3,681,023 and U.K. Pat. No. 1,256,608.

It has also heretofore been proposed to irradiate fibers of homopolymers of polyacrylonitrile or copolymers of polyacrylonitrile with 1% and 5% methylacrylate with gamma radiation from a cobalt-60 source. See, Simitzis, J., "The Effect of $\gamma$-Irradiation on the Pyrolysis Behavior of Polyacrylonitrile Fibers", Atomkernenergie Kerntechnik 33 [1], 52–56 (1979); and Simitzis, J., "On the Properties and Pyrolysing Behavior of $\gamma$-Irradiated Polyacrylonitrile Fibers", Atomkernenergie Kerntechnik, 38 [3], 205–210 (1981).

However, at the disclosed dose rate of 0.184 megarads per hour, the acrylic fibers involved in the Simitzis studies must have residence times of exposure to gamma radiation on the order of 70 to 500 hours to provide energy absorption of from 13 to 90 megarads. Such residence times would severely lengthen the conversion of acrylic fibrous material to carbon fibers, and make the Simitzis process not commercially viable.

Further, while Simitzis recognizes that prior gamma irradiation of the fibers accelerates the subsequent oxidation, the indicated accelerated stabilization times are still on the order of 1.5 hours at 255° C.

Therefore, it is an object of the present invention to provide an improved process for the thermal stabilization of acrylic fibrous materials.

It is an object of the present invention to provide an improved process for the thermal stabilization of an acrylic fibrous material which surprisingly can be carried out on an expeditious basis.

It is an object of the present invention to provide an improved process for the thermal stabilization of an acrylic fibrous material which can be carried out without the excessive usage of energy as commonly required in the prior art.

It is an object of the present invention to provide an improved process for the thermal stabilization of an acrylic fibrous material wherein oxygen readily enters the interior of the acrylic fibrous material without any substantial formation of a diffusion limiting skin on the outer surfaces of the fibers during the course of the thermal stabilization reaction.

It is another object of the present invention to provide an efficient process for the stabilization of an acrylic fibrous material immediately prior to the carbonization or carbonization and graphitization of the same.

It is an object of the present invention to produce an improved process for the stabilization of an acrylic fibrous material wherein thermal stabilization is expedited (i.e., occurs in 10 to 30 minutes).

It is a further object of the present invention to provide an improved process for the stabilization of an acrylic fibrous material that results in a significant reduction in the weight loss suffered by the acrylic fibrous material upon carbonization.

It is another object of the present invention to provide an improved process for the stabilization of an acrylic fibrous material wherein said material may be introduced into the stabilization oven at a substantially higher temperature than commercially utilized in the prior art, thus further accelerating thermal stabilization.

These and other objects of the invention, as well as its scope, nature, and utilization will be apparent to those skilled in the art from the following detailed description and appended claims.

SUMMARY OF THE INVENTION

An improved process is provided for the stabilization of an acrylic fibrous material selected from the group consisting of an acrylonitrile homopolymer and an acrylonitrile copolymer containing at least 85 mole percent acrylonitrile units and up to 15 mole percent of one or more monovinyl units copolymerized therewith, said fibrous material comprising a plurality of filaments having a denier per filament of about 0.6 to 1.5, comprising the steps of (a) continuously passing a continuous length of the acrylic fibrous material through a zone of electron radiation so as to provide an energy absorption of from about 5 to about 30 megarads wherein the residence time of the acrylic fibrous material in the zone is less than five seconds, and (b) continuously passing a continuous length of the acrylic fibrous material through a thermal stabilization zone, wherein the acrylic fibrous material is heated in an oxygen-containing atmosphere provided at a temperature in the range of about 220° C. to 310° C. for about 10 to 30 minutes; whereby a stabilized acrylic fibrous material is formed which is black in appearance, retains its original fibrous configuration substantially intact, and which is nonburning when subjected to an ordinary match flame.

DESCRIPTION OF THE PREFERRED EMBODIMENTS

The acrylic fibrous material which is thermally stabilized in accordance with the process of the present invention may be present in any one of a variety of physical configurations. For instance, the fibrous material may be present in the form of continuous single filaments, staple fibers, tows, yarns, tapes, knits, braids, fabrics, or other fibrous assemblages. In a preferred embodiment of the invention the acrylic fibrous material is present as a continuous length of multifilamentary material, e.g., a multifilamentary yarn or tow. In a particularly preferred embodiment the acrylic fibrous material is in the form of a flat tow having a relatively thin thickness (e.g., 0.5 to 1.5 mm.). If the tow is too thick then the inner fibers will tend to be unduly shielded by the outer fibers. Alternatively, if the tow thickness is too thin and the filaments noncontiguous, then insufficient mass may be presented for efficient adsorption of the energy provided by the electron radiation.

The acrylic fibrous material which serves as the starting material may be prepared by conventional techniques which are well known to those skilled in the art. For instance, dry spinning or wet spinning techniques may be employed. The denier of the acrylic fibrous material may be varied. In a preferred embodiment the acrylic fibrous material possesses a denier per filament of approximately 0.6 to 1.5 (e.g., 0.9) immediately prior to the thermal stabilization treatment.

The acrylic fibrous material which serves as the starting material is either an acrylonitrile homopolymer or an acrylonitrile copolymer which contains at least 85 mole percent of acrylonitrile units and up to 15 mole percent of one or more monovinyl units copolymerized therewith. Preferred acrylonitrile copolymers contain at least 95 mole percent of acrylonitrile units and up to 5 mole percent of one or more monovinyl units copolymerized therewith. Each monovinyl unit may be derived from styrene, methyl acrylate, methyl methacrylate, vinyl acetate, vinyl chloride, vinylidene chloride, vinyl pyridine, etc. In a particularly preferred embodiment the acrylonitrile copolymer comprises 98 mole percent acrylonitrile units and 2 mole percent methyl acrylate units.

During the process of the present invention, the acrylic fibrous material is first subjected to electron radiation so as to provide an energy absorption of about 5 to 30 megarads in a residence time of less than five seconds. In a preferred embodiment a continuous length of acrylic fibrous material is continuously passed in the direction of its length through a zone of electron radiation. The electron radiation may be derived from any conventional source. The preferred source is an electron curtain. An electron curtain provides a narrow, linear unscanned beam of electrons. The curtain spans a relatively wide area, and is able to accomodate a plurality of continuous lengths of acrylic fibrous material. When irradiating a flat tow of approximately 6000 substantially parallel acrylic filaments of 0.9 denier per filament, particularly good results have been obtained when using an electron curtain, Model CB 200/50/30, manufactured by Energy Sciences, Inc.

The desired amount of energy absorbed per gram of acrylic fibrous material varies according to the bundle size of the acrylic fibrous material being treated with electron radiation, i.e., from 5 to 30 megarads. For a fiber bundle comprising 6000 filaments each of 0.9 denier, a dose of 10 to 20 megarads has been found highly effective. A radiation dosage substantially greater than 30 megarads provides no advantage and, indeed, such higher dosages may seriously degrade the acrylic fibrous material.

The radiation dosage may be provided in less than about five seconds by continuously passing in the direction of its length a continuous length of, e.g., multifilamentary acrylic fibrous material under constant longitudinal tension, through a zone of electron radiation. In a preferred embodiment from 5 to 30 megarads is applied to the acrylic fibrous material in less than three seconds.

After the acrylic fibrous material is subjected to electron radiation, the continuous length of material is subsequently continuously passed through a thermal stabilization zone. In a preferred embodiment, the continuous length of fibrous material is continuously passed directly from the zone of electron radiation to the thermal stabilization zone.

In the thermal stabilization zone the continuous length of acrylic fibrous material is continuously heated in an oxygen-containing atmosphere so as to become thermally stable and ready for further carbonization. The acrylic fibrous material may be heated in stages at different temperatures or at a single temperature. It is, of course, essential that any maximum temperature experienced by the acrylic fibrous material upon heating not exceed the temperature at which the original fibrous configuration is destroyed.

The thermally stabilized acrylic fibrous material is thereby rendered black in appearance and non-burning when subjected to an ordinary match flame, while retaining the original fibrous configuration substantially intact. It has surprisingly been found that the exposure of the acrylic fibrous material to 5 to 30 megarads in less than five seconds enables the desired thermal stabilization to be accomplished in a highly expeditious manner.

The molecular oxygen-containing gaseous atmosphere in which the thermal stabilization reaction is carried out preferably is air. Alternatively, substantially pure oxygen or other oxygen-containing atmospheres may be selected. In a preferred embodiment the oxygen-containing atmosphere is simple air which is provided at a temperature in the range of 220° C. to 310° C.

In a preferred embodiment, the continuous length of multifilamentary acrylic fibrous material is provided under a constant longitudinal tension when undergoing thermal stabilization. For instance, the tension can be selected so as to accomodate approximately 0 to 20 percent longitudinal shrinkage during the thermal stabilization treatment in the absences of any substantial filament breakage. The rollers which feed and withdraw the acrylic fibrous material to and from the zone in which the electron radiation takes place may be driven at the same rate and a constant tension applied to the continuous length of fibrous material.

The oven temperature for stabilization of acrylic fibrous material during the course of the thermal stabilization treatment may be monitored by conventional thermocouple devices.

It is within the ambit of the process of the present invention to contact the acrylic fibrous material with solutions of various chemical additives prior to exposing the material to electron radiation. Such chemical additives include methanesulfonic acid, phenylphosphonic acid, and tetraphenylphosphonium bromide. Commonly assigned U.S. Pat. No. 4,002,426 discloses methanesulfonic acid as a thermal stabilization promoting agent, and U.S. application Ser. No. 360,012, filed Mar. 19, 1982, also commonly assigned, discloses tetraphenylphosphonium bromide as such an agent. U.S. Pat. No. 4,002,426 and Ser. No. 360,012 are hereby incorporated by reference. Typically, the fibrous material absorbs from three to five percent of its weight in such chemical additives. Fibers contacted with solutions of these additives exhibit further accelerated thermal stabilization.

The process of the present invention provides an extremely rapid technique to thermally stabilize an acrylic fibrous material when compared to prior art processes. It has been found, for instance, that the desired thermal stabilization may be accomplished within approximately 20 minutes if the acrylic fibrous material is first treated with a dose of electron radiation of about 5 to 30 megarads. At the conclusion of the thermal stabilization reaction the fibrous material is black in appearance and non-burning when subjected to an ordinary match flame.

It has been found when a cross-section of the stabilized acrylic fibrous material is subjected to optical or scanning electron microscopy that the interior portions of the fibers are uniformly black in appearance in spite of the relatively brief nature of thermal stabilization treatment. Additionally, when the stabilized fibers are subjected to differential scanning calorimetry analysis (DSC) the usual exotherm commonly exhibited upon the heating of non-thermally stabilized acrylic fibers is substantially eliminated. Such stabilized acrylic fibers contain about 60 to 64 percent carbon by weight. When the stabilized acrylic fibers are analyzed for bound oxygen content employing the Unterzaucher analysis, bound oxygen values of at least 7 to 10 percent by weight have been observed.

The process of the present invention is highly flexible and offers significant advantages when compared to acrylic fiber stabilization processes of the prior art. It has unexpectedly been found that the thermal stabilization of certain acrylic fibrous material may be greatly accelerated by continuously passing a continuous length of the acrylic fibrous material through a zone of electron radiation that provides an energy absorption of 5 to 30 megarads, wherein the residence time of the material in the zone of electron radiation is less than five seconds. Such an electron radiation treatment has been found to permit complete thermal stabilization of the acrylic fibrous material in 10 to 30 minutes in an oxygen-containing atmosphere provided at a temperature of about 220° C. to 310° C. The prior art is entirely devoid of any suggestion that a short-lived electron radiation treatment allows for the rapid thermal stabilization of acrylic fibrous material.

In addition, it has been surprisingly discovered that the process of the present invention results in a significant reduction in the weight loss suffered by the acrylic fibrous material upon carbonization. Reduced weight loss of the acrylic fibrous material precursor upon thermal stabilization results in substantial cost savings during the production of carbon fiber. Further, acrylic fibrous material comprising approximately 98 mole percent acrylonitrile units and 2 mole percent methyl acrylate units, when exposed to electron radiation, exhibits a decreased initial rate of weight loss at 310° C. as compared to identical but unradiated acrylic fibrous material. Limiting the initial rate of weight loss is critical to reducing the total weight lost upon carbonization.

It has further been discovered that the process of the present invention permits the introduction of acrylic fibrous material into the stabilization oven at a substantially higher temperature than previously known in the art without fusing the filaments of the fibrous material and thereby making the material unusable. For example, acrylic fibrous material comprising 6000 filaments each of 0.9 denier and composed of approximately 98 mole percent acrylonitrile units and 2 mole percent methyl acrylate units, which is treated with 20 megarads of electron radiation in less than five seconds, may be introduced into a thermal stabilization oven at just below 300° C. without destroying the original fibrous configuration. Temperatures greater than about 270° C. would typically destroy identical but unradiated acrylic fibrous material of like bundle size and denier. The ability to introduce the acrylic fibrous material to thermal stabilization at higher temperatures further accelerates stabilization as per the Arrhenius relationship $K=A^{-E/RT}$, where K is the rate constant, A is the pre-exponential factor, E is the activation energy, R is the gas constant, and T is the temperature of the reaction in degrees Kelvin.

Non-burning fabrics may be formed from the resulting stabilized acrylic fibrous material. Alternatively, the stabilized acrylic fibrous material may be used as a fibrous precursor for the formation of carbon fibers (i.e., of either amorphous or graphitic carbon). Such carbon fibers contain at least 90 percent carbon by weight (e.g., at least 95 percent carbon by weight) and may be formed by heating the previously stabilized acrylic fibers at a temperature of at least approximately 900° C. in a non-oxidizing atmosphere (e.g., nitrogen, argon, etc.) in accordance with techniques well known in the art.

The following Example is presented as a specific illustration of the claimed process. It should be understood, however, that the invention is not limited to the specific details of the example.

EXAMPLE

The acrylic fibrous material selected for thermal stabilization was a continuous length of a tow consisting of approximately 6000 substantially parallel filaments of 0.9 denier per filament. The filaments had been formed by wet spinning and were composed of approximately 98 mole percent acrylonitrile units and 2 mole percent methyl acrylate units.

A tow sample of acrylic fibrous material which had not previously undergone thermal stabilization was provided on a supply roll. The tow was continuously withdrawn from the supply roll by the driven rotation of a first pair of feed rolls which were provided with a rubber surface to grip the tow of the acrylic fibrous material as it passed between them. The tow next passed over a pair of idler rolls and an intermediate idler roll. The tow was passed by the idler rolls to a first series of five additional idler rolls which served to flatten the tow to a relatively constant width of approximately 1 cm. and a relatively thin thickness of approximately 1 mm. Following passage through the zone of electron radiation the tow passed over a second series of three idler rolls and then between a pair of driven take-up rolls which were also provided with a rubber surface to grip the tow of irradiated acrylic fibrous material as it passed between them. The tow of irradiated acrylic fibrous material was then collected on a roll.

The tow of acrylic fibrous material was passed through the zone of electron radiation at a rate of 4.35 inches/second. The residence time of the tow in the zone of electron radiation was approximately 2.4 seconds. The rate of passage of the tow through the zone of electron radiation was controlled by the speed of rotation of the feed rolls and the take-up rolls. A constant tension of approximately 0.1 gram per denier was maintained on the acrylic fibrous material by means of a controlled-speed, differential between the feed roll and take-up roll. Nitrogen at ambient temperature (i.e., approximately 25° C.) surrounded the fiber in the exposure region of the apparatus.

The electron radiation was supplied by an electron curtain, Model CB200/50/30 manufactured by Energy Sciences, Inc. Three sample tows were individually run through the aforedescribed apparatus arrangement and subjected to radiation dose levels of 5, 10, or 20 megarads.

Subsequent to the electron radiation treatment, the three sample tows subjected to electron radiation and an unradiated control of like acrylic fibrous material were individually passed through a stabilization oven wherein the samples and control were individually heated by air provided at 265° C. for 20 minutes The three acrylic fibrous material sample tows were found to have undergone complete thermal stabilization in that the samples retain their original fibrous configuration substantially intact, were black in appearance, and were non-burning when subjected to an ordinary match flame. The samples stabilized by 20 megarads possessed an average bound oxygen content of approximately 7.0 percent by weight when subjected to the Unterzaucher analysis. The control acrylic fibrous material was black but burned when subjected to an ordinary match flame; its oxygen content was only about 3%.

The three sample tows stabilized in the Example and the control were examined by thermogravimetric analysis so as to determine weight retention at 1000° C.

The samples and control were placed in an oven at 50° C. in a nitrogen atmosphere and the temperature was raised 20° C. per minute until 1000° C. was reached. The weight retained by the samples and control was as follows:

TABLE 1

| Electron Radiation Dose (megarads) | Weight Retained (%) |
|---|---|
| 0 | 45 |
| 5 | 55 |
| 10 | 58 |
| 20 | 58 |

The three sample tows subjected to 5, 10, or 20 megarads retained the largest percentage of their original weight. Further, the initial rate of weight loss at 310° C., see Table 2, was found to be much lower for the three sample tows than the control.

TABLE 2

| Electron Radiation Dose (megarads) | Initial Rate of Weight Loss in $N_2$ Atmosphere at 310° C. (%) |
|---|---|
| 0 | 13 |
| 5 | 5 |
| 10 | 2 |
| 20 | 2 |

Although the invention has been described with preferred embodiments it is to be understood that variations and modifications may be employed without departing from the concept of the invention as defined in the following claims.

We claim:

1. An improved process for the stabilization of an acrylic fibrous material selected from the group consisting of an acrylonitrile homopolymer and an acrylonitrile copolymer containing at least 85 mole percent acrylonitrile units and up to 15 mole percent of one or more monovinyl units copolymerized therewith, said fibrous material comprising a plurality of filaments having a denier per filament of about 0.6 to 1.5, comprising the steps of (a) continuously passing a continuous length of said acrylic fibrous material through a zone of electron radiation so as to provide an energy absorption of from about 5 to about 30 megarads wherein the residence time of said acrylic fibrous material in said zone is less than five seconds, and (b) continuously passing a continuous length of said acrylic fibrous material through a thermal stabilization zone, wherein said acrylic fibrous material is heated in an oxygen-containing atmosphere provided at a temperature in the range of about 220° C. to 310° C. for about 10 to 30 minutes, whereby a stabilized acrylic fibrous material is formed which is black in appearance, retains its original fibrous configuration substantially intact, and which is non-burning when subjected to an ordinary match flame.

2. An improved process for the stabilization of an acrylic fibrous material according to claim 1 wherein said acrylic fibrous material is selected from the group consisting of an acrylonitrile homopolymer and an acrylonitrile copolymer containing at least 95 mole percent of acrylonitrile units and up to 5 mole percent of one or more monovinyl units copolymerized therewith.

3. An improved process for the stabilization of an acrylic fibrous material according to claim 1 wherein said acrylic fibrous material is selected from the group consisting of an acrylonitrile homopolymer and an acrylonitrile copolymer containing at least 98 mole percent of acrylonitrile units and up to 2 mole percent of one or more monovinyl units copolymerized therewith.

4. An improved process for the stabilization of an acrylic fibrous material according to claim 1 wherein said acrylic fibrous material is an acrylonitrile homopolymer.

5. An improved process for the stabilization of an acrylic fibrous material according to claim 1 wherein said acrylic fibrous material has a denier per filament of about 0.9.

6. An improved process for the stabilization of an acrylic fibrous material according to claim 1 wherein said residence time of said acrylic fibrous material in said zone of electron radiation is less than three seconds.

7. An improved process for the stabilization of an acrylic fibrous material selected from the group consisting of an acrylonitrile homopolymer and an acrylonitrile copolymer containing at least 95 mole percent acrylonitrile units and up to 5 mole percent of one or more monovinyl units copolymerized therewith, said fibrous material comprising a plurality of filaments having a denier of about 0.6 to 1.5, comprising the steps of (a) continuously passing a continuous length of said acrylic fibrous material through a zone of electron radiation so as to provide an energy absorption of from about 10 to about 20 megarads wherein the residence time of said acrylic fibrous material in said zone is less than five seconds, (b) continuously passing said continuous length of fibrous material from said zone of electron radiation to a thermal stabilization zone, and (c) continuously passing said acrylic fibrous material through said thermal stabilization zone wherein said acrylic fibrous material is heated in an oxygen containing atmosphere provided at a temperature of about 265° C. for about 20 minutes, whereby a stabilized acrylic fibrous material is formed which is black in appearance, retains its original fibrous configuration substantially intact, and which is non-burning when subjected to an ordinary match flame.

8. An improved process for the stabilization of an acrylic fibrous material according to claim 7 wherein said acrylic fibrous material has denier per filament of about 0.9.

9. An improved process for the stabilization of an acrylic fibrous material according to claim 7 wherein said residence time of said acrylic fibrous material in said zone of electron radiation is less than three seconds.

* * * * *